US008123002B2

(12) United States Patent
Smith et al.

(10) Patent No.: US 8,123,002 B2
(45) Date of Patent: Feb. 28, 2012

(54) ELEVATOR ROPE POSITIONING APPARATUS

(75) Inventors: Rory S. Smith, El Cajon, CA (US); Stefan Kaczmarczyk, Northampton (GB); Jim Nickerson, Spring Valley, CA (US); Patrick M. Bass, Hernando, MS (US)

(73) Assignee: Thyssenkrupp Elevator Capital Corporation, Troy, MI (US)

( * ) Notice: Subject to any disclaimer, the term of this patent is extended or adjusted under 35 U.S.C. 154(b) by 703 days.

(21) Appl. No.: 12/210,725

(22) Filed: Sep. 15, 2008

(65) Prior Publication Data

US 2009/0229922 A1 Sep. 17, 2009

Related U.S. Application Data

(60) Provisional application No. 60/972,495, filed on Sep. 14, 2007, provisional application No. 60/972,506, filed on Sep. 14, 2007, provisional application No. 61/089,633, filed on Aug. 18, 2008.

(51) Int. Cl.
*B66B 1/34* (2006.01)

(52) U.S. Cl. ..... 187/393; 187/266

(58) Field of Classification Search ..... 187/250, 187/254, 256, 258, 260, 264, 265, 266, 277, 187/284, 391, 393
See application file for complete search history.

(56) References Cited

U.S. PATENT DOCUMENTS

| | | | | |
|---|---|---|---|---|
| 664,041 | A * | 12/1900 | Hadfield | 187/256 |
| 4,716,989 | A * | 1/1988 | Coleman et al. | 187/411 |
| 5,788,018 | A * | 8/1998 | Mendelsohn et al. | 187/404 |
| 5,861,084 | A | 1/1999 | Barker et al. | |
| 6,065,569 | A | 5/2000 | Fuller | |
| 6,966,408 | B2 * | 11/2005 | Sweet | 187/264 |
| 7,481,299 | B2 * | 1/2009 | Mustalahti et al. | 187/264 |
| 7,798,290 | B2 * | 9/2010 | Mustalahti et al. | 187/391 |
| 7,878,306 | B2 * | 2/2011 | Siewert et al. | 187/264 |
| 7,913,819 | B2 * | 3/2011 | Siikonen et al. | 187/382 |
| 2010/0213013 | A1 * | 8/2010 | Urata | 187/278 |
| 2011/0017551 | A1 * | 1/2011 | Aulanko et al. | 187/249 |

FOREIGN PATENT DOCUMENTS

| | | |
|---|---|---|
| JP | 2001 247263 | 9/2001 |
| JP | 2003 104656 | 4/2003 |

OTHER PUBLICATIONS

U.S. Appl. No. 61/073,911, filed Jun. 19, 2008, Smith et al.
U.S. Appl. No. 60/972,495, filed Sep. 14, 2007, Smith et al.
U.S. Appl. No. 60/972,506, filed Sep. 14, 2007, Smith et al.
U.S. Appl. No. 61/089,633, filed Aug. 18, 2008, Smith et al.
Abstract for JP2001247263.
Abstract for JP2003104656.

* cited by examiner

*Primary Examiner* — Anthony Salata
(74) *Attorney, Agent, or Firm* — Frost Brown Todd LLC

(57) ABSTRACT

A system and method for minimizing compensation rope sway by altering the natural frequency of compensation ropes using servo actuators. The rope sway may be minimized by moving the compensation sheave to adjust the tension of the compensation rope or adjusting the position of the termination of a compensation rope to account for changes in the position of a structure. Servo actuators may also be used to re-level the elevator car to account for rope stretch.

10 Claims, 3 Drawing Sheets

ELEVATOR ROPE POSITIONING APPARATUS

PRIORITY

The application claims priority from the disclosure of U.S. Provisional Patent Application Ser. No. 60/972,495, entitled "Method and Apparatus to Minimize Compensation Rope Sway in Elevators," filed Sep. 14, 2007, U.S. Provisional Patent Application Ser. No. 60/972,506, entitled "Method and Apparatus to Minimize Compensation Rope Sway Through Tendon Control in Elevators," filed Sep. 14, 2007, and U.S. Provisional Patent Application Ser. No. 61/089,633, entitled "Multi-Purpose Device for High Rise Elevators," filed Aug. 18, 2008, which are herein incorporated by reference.

FIELD OF THE INVENTION

The present invention relates, in general, to elevator systems and, in particular, to actively controlling the natural frequency of tension members.

BACKGROUND OF THE INVENTION

Tension members such as ropes and cables are subject to oscillations. These members can be excited by external forces such as wind. If the frequency of exciting forces matches the natural frequency of the tension member, then the tension member will resonate.

High velocity winds cause buildings to sway back and forth. The frequency of the building sway can match the natural frequency of the elevator causing resonance. In resonance, the amplitude of the oscillations increases unless limited by some form of dampening. This resonance can cause significant damage to both the elevator system and the structure.

BRIEF DESCRIPTION OF THE DRAWING

The accompanying drawings incorporated in and forming a part of the specification illustrate several aspects of the present invention, and together with the description serve to explain the principles of the invention; it being understood, however, that this invention is not limited to the precise arrangements shown. In the drawings, like reference numerals refer to like elements in the several views. In the drawings.

DETAILED DESCRIPTION OF THE INVENTION

Two major problems plague high rise elevators with long hoist ropes. These are rope sway and re-leveling due to rope elongation. Rope sway, particularly compensation rope sway, is a major problem in high rise buildings.

The fundamental frequency (also called a natural frequency) of a periodic signal is the inverse of the pitch period length. The pitch period is, in turn, the smallest repeating unit of a signal. The significance of defining the pitch period as the smallest repeating unit can be appreciated by noting that two or more concatenated pitch periods form a repeating pattern in the signal. In mechanical applications a tension member, such as a suspension rope, fixed at one end and having a mass attached to the other, is a single degree of freedom oscillator. Once set into motion, it will oscillate at its natural frequency. For a single degree of freedom oscillator, a system in which the motion can be described by a single coordinate, the natural frequency depends on two system properties; mass and stiffness. Damping is any effect, either deliberately engendered or inherent to a system, that tends to reduce the amplitude of oscillations of an oscillatory system.

Because of the low mass of the compensation sheave, the natural frequency of the compensation ropes is very low and is normally between 0.05 Hz and 1 Hz. The following equation (Equation 1) is used to calculate the natural frequency of compensation ropes in Hz:

$$f_n = \frac{n}{2L}\sqrt{g\left(\frac{M}{2_{n_c}m} + \frac{L}{2}\right)} \tag{1}$$

where g=32.2 ft/s$^2$, n=vibration mode number, $n_c$=number of ropes, L=length of the rope (in feet; ft), M=mass of the compensating sheave assembly (in pound-mass; lb), and m=mass of the rope per unit length (in pound-mass per feet; lb/ft).

High rise buildings are known to sway during windy conditions. The frequency of the building sway is also generally between 0.05 and 1 Hz. Because the natural frequency of the compensation ropes is very close to the natural frequency of the building, resonance often occurs. Compensation rope resonance can cause the ropes to strike the walls and elevator doors causing damage and frightening passengers.

Figure 1:
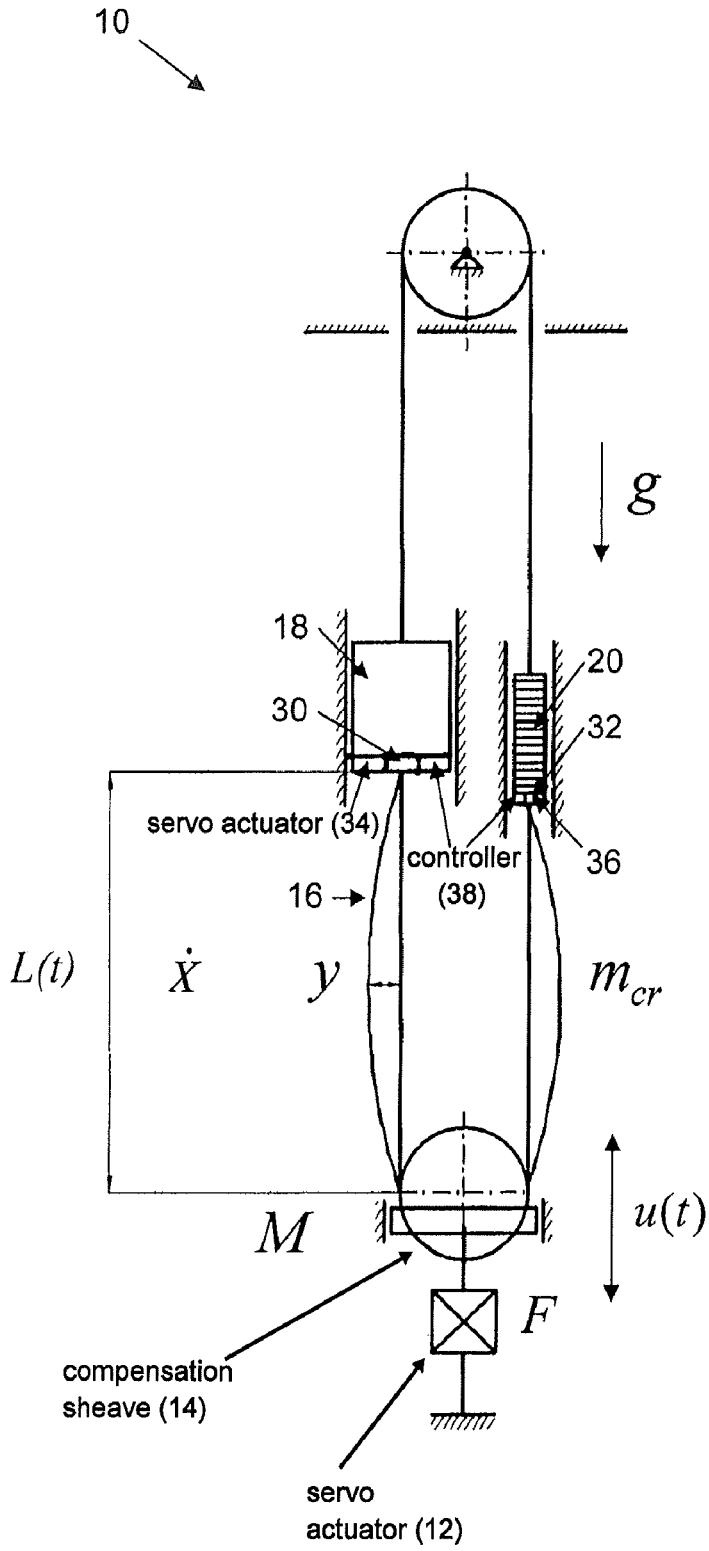
FIG. 1 illustrates an elevator system having an adjustable compensation rope sheave.

To avoid this resonance, the frequency of the ropes can be adjusted such that it is different from that of the structure itself. Referring to FIG. 1, an elevator system (10) comprises one or more servo actuators (12) attached to a compensation sheave (14). The servo actuator (12) is configured to move the sheave vertically within a predetermined range (u). A compensation rope (16) is wrapped around the compensation sheave (14) and is affixed at a first end to an elevator car (18) and at a second end to a counterweight (20). The compensation rope (16) will have a natural frequency that is a function of the length of the rope and the tension of the compensation rope (16). In high rise buildings, the natural frequency of the compensation rope (16) may match the buildings natural frequency, thereby leading to potentially damaging resonance.

The compensation rope (16) may be affixed to the elevator (18) and/or counterweight (20) with a rope tension equalizer such as that described, for example, in U.S. Provisional Patent Application Ser. No. 61/073,911, filed Jun. 19, 2008, which is herein incorporated by reference. Any suitable rope, such as aramid or wire rope, may be used in accordance with versions described herein. In one version, rope having a relatively high natural frequency may be used.

In the version of the elevator system (10) shown in FIG. 1, one or more servo actuators (12) are modulated in response to a control algorithm that actively damps the oscillation of the ropes by varying the tension in the compensation ropes. The term "tendon control" refers to actively adjusting the tension or active suppression of a tension member or compensation rope to alter the natural frequency of the tension member.

The servo actuator (12) may be a servomotor, servomechanism, or any suitable automatic device that uses a feedback loop to adjust the performance of a mechanism in modulating tendon control. The actuators could be hydraulic piston and cylinders, ball screw actuators, or any actuator commonly used in the machine tool industry. In particular, the servo actuator (12) may be configured to control the mechanical position of the compensation sheave (14) along a vertical axis by creating mechanical force to urge the compensation sheave (14) in a generally upward or downward direction. Mechanical forces may be achieved with an electric motor, hydraulics, pneumatics, and/or by using magnetic principles.

In one version, the servo actuator (12) operates on the principle of negative feedback, where the natural frequency of the compensation rope (16) is compared to the natural frequency of the building as measured by any suitable transducer or sensor. A controller (not shown) associated with the servo actuator (12) may be provided with an algorithm to calculate the difference between the natural frequency of the compensation rope (16) and the natural frequency of the building. If the difference between these frequencies is within a predetermined range, the controller may instruct the servo actuator (12) to adjust the position of the compensation sheave (14) until the respective frequencies are sufficient different. It will be appreciated that any suitable applications of control theory may be applied to versions described herein.

In one version, to measure the natural frequency of a building, an accelerometer is positioned in the elevator machine room and the output of the accelerometer is twice integrated to produce displacement. During periods of high velocity winds the building will sway. The twice integrated output of the accelerometer may be used to determine the displacement of the machine room from its normal location.

Several control strategies can be applied to affect tendon control such as, for example, exponential stabilization, proportional, integral, and derivative (PID) feedback, and fuzzy logic control. Any suitable control means may be associated with the controller to modulate the natural frequency of the compensation rope (16). Any suitable active vibration control (AVC) techniques involving actuators to generate forces and applying them to the structure in order to reduce its dynamic response may be utilized.

Figure 2:
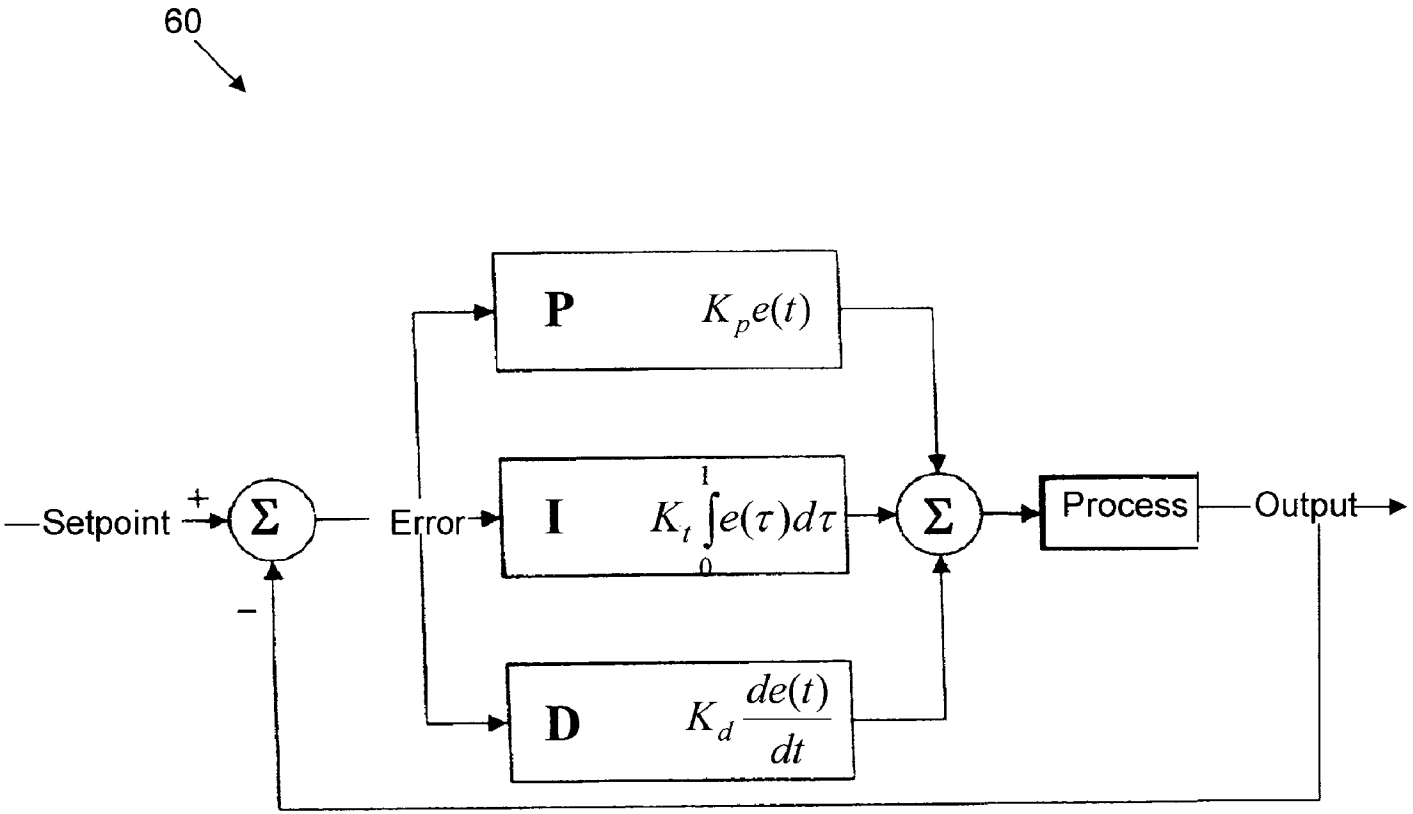
FIG. 2 illustrates one version of a PID controller that may be used in associated with the elevator system of FIG. 1.

Referring to FIG. 2, the rope sway may be modulated, for example, by a PID controller that monitors the natural frequencies of the compensation rope (16) and the building to prevent resonance. Modulating the natural frequency of the compensation rope (16) in the disclosed manner allows for the tension member to be actively damped. FIG. 2 illustrates a schematic of one version of a proportional-integral-derivative controller or "PID controller" that may be used to actively damp a tension member. The PID controller may be implemented in software in programmable logic controllers (PLCs) or as a panel-mounted digital controller. Alternatively, the PID controller may be an electronic analog controller made from a solid-state or tube amplifier, a capacitor, and a resistance. It will be appreciated that any suitable controller may be incorporated, where versions may use only one or two modes to provide the appropriate system control. This may be achieved, for example, by setting the gain of undesired control outputs to zero to create a PI, PD, P, or I controller.

It will be appreciated that any suitable modifications to the PID controller may be made including, for example, providing a PID loop with an output deadband to reduce the frequency of activation of the output. In this manner the PID controller will hold its output steady if the change would be small such that it is within the defined deadband range. Such a deadband range may be particularly effective for actively damping tension members where a precise setpoint is not required. The PID controller can be further modified or enhanced through methods such as PID gain scheduling or fuzzy logic.

In addition to rope sway, rope stretch during loading and unloading can cause problems in high rise elevators. Rope stretch is defined by the following equation:

$$S = \frac{P \times L}{A \times E \times n} \tag{2}$$

where S=stretch, P=load, L=length of the rope, A=cross sectional area of the rope, E=Young's Modulus, and n=number of ropes.

High rise elevators typically have one or two entrances at or near ground level and then have an express zone with no stops until a local zone is reached at the top of the building. In a 100 story building, the local zone might have 10 stops and the express zone could bypass 80 or 90 floors.

Another high rise application is the shuttle elevator. For example, a shuttle elevator might have only two stops, the ground floor and an observation level on the 100th floor. Such an elevator might travel 450 meters between floors. At the top floor of such an elevator rope stretch is not as significant a problem because the rope length is short. However, at lower landings rope stretch is a problem due to the much longer rope length.

Referring back to FIG. 1, in one version, the servo actuators (12) are configured to control rope stretch by performing re-leveling of the elevator car (18) at the lower landings. As people enter and leave an elevator car (18) it becomes necessary to re-level the car (18). While this is a routine procedure on all elevators, it is a special problem on high rise elevators at the lower floors because there is a time delay between when the compensation sheave (14) turns and when the car (18) moves. This delay is due to the stretch of the compensation rope (16) and can cause the car (18) to oscillate at the floor. Prior systems have attempted to minimize rope stretch by adding additional compensation ropes, but these ropes add extra weight and cost, generally do not improve the safety of the system, and function almost exclusively to prevent rope stretch. The version of the elevator system (10) shown in FIG. 1 may be configured to re-level the car (18) to reduce rope stretch.

Figure 3:
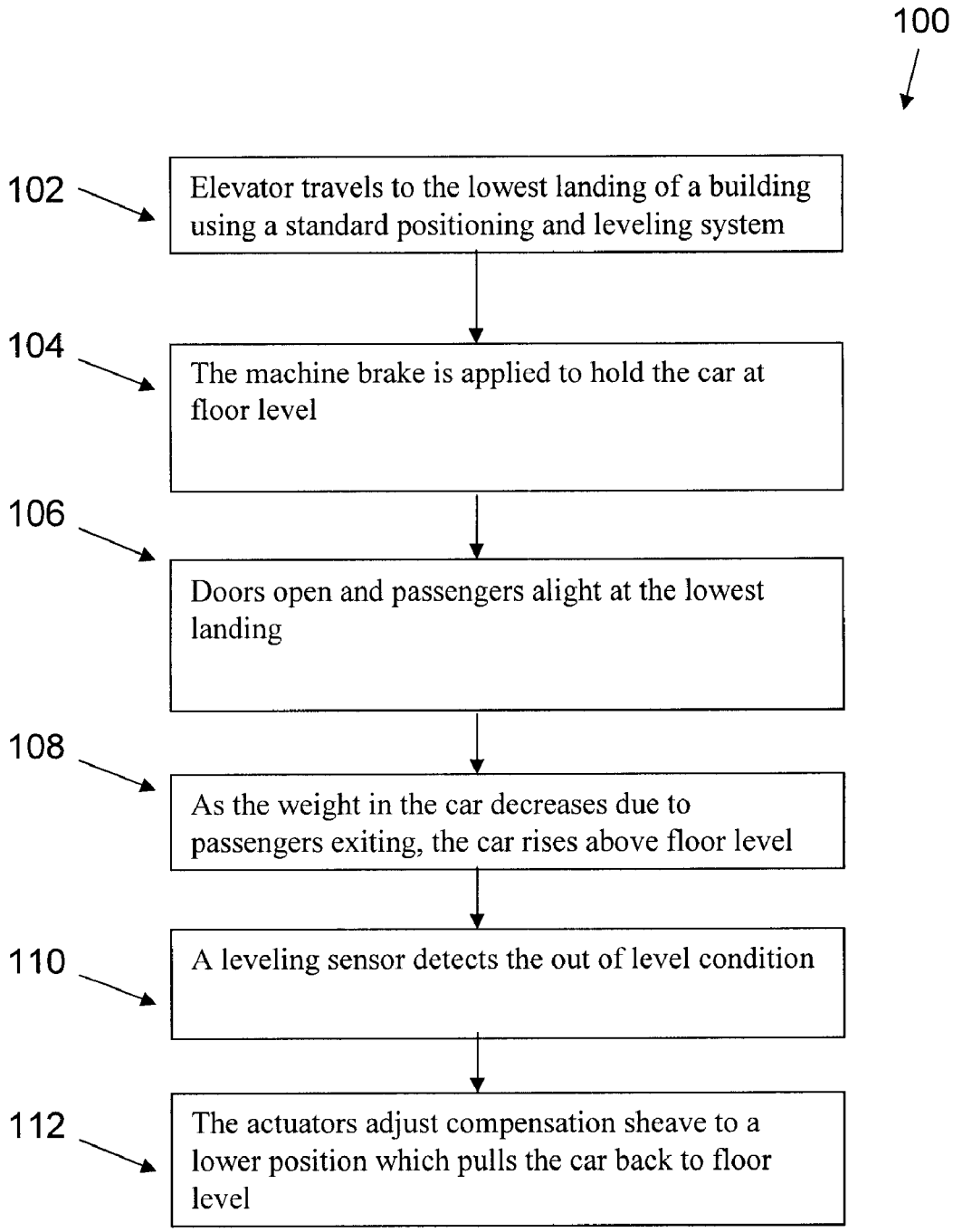
FIG. 3 illustrates one version of a method for re-leveling an elevator system to minimize the effects of rope stretch.

Referring to FIG. 3, one version of a method (100) is shown for re-leveling an elevator car (18) with a servo actuator (12). The steps of method (100) comprise:

Step (102) includes an elevator car (18) traveling from an upper floor to the lowest floor of a building. Step (104) comprises applying a machine brake to hold the elevator car (18) at the lowest floor level. Step (106) comprises opening the door of the elevator and allowing passenger to enter and depart at the lowest landing. Step (108) comprises the elevator car (18) rising as the weight of the car (18) decreases due to departing passengers. Step (110) comprises using a leveling sensor to determine how far the elevator car (18) has drifted away from the level position. Step (112) comprises using a servo actuator to adjust the position of the compensation sheave (14) to account for the drift of the elevator car (18). Step (112) further comprises adjusting the position of the compensation sheave (14) such that the elevator car (18) remains substantially level through the loading and unloading process. It will be appreciated that re-leveling may be performed at any suitable time at any suitable floor.

Use of the elevator system (10) in accordance with the method (100) allows for the elevator car (18) to be re-leveled without the addition of additional ropes. For example, in an installation with 22 mm ropes, seven ropes are generally required for hoisting, but nine may be supplied to control rope stretch. The method (100) may eliminate the need for the additional two ropes needed to help control rope stretch. Additionally, the remaining ropes will be under higher tension and, thus, will have higher frequencies, which may be beneficial is avoiding resonance.

An additional benefit of the method (100) may be the reduction of risk due to unintended motion when the doors are open. It is possible, as a result of a control failure, for the car to move rapidly while passengers are entering or exiting the car because the machine brake is lifted (disengaged) and the machine is powered. The obvious result of this is severe harm or death of the passengers. Method (100) may reduce the likelihood of harm because the re-leveling is accomplished using the actuators whose range of motion is limited.

The position of the compensation rope (16) relative to the building is also a factor in determining whether resonance will occur. Referring back to FIG. 1, the compensation rope (16) may be attached to terminations on the bottom of the elevator car (18) and/or counterweight (20) associated with a first moveable carriage (30) and a second moveable carriage (32), respectively. In one version, the first and second moveable carriages are moveable in both the front to back (X) and side to side directions (Y). Attached to the carriage are a plurality of servo actuators (34), (36) that move the first and second moveable carriages in the X and Y directions. Movement of the location of the termination of the compensation rope (16) may help prevent the elevators system (10) from entering into resonance with the building by shifting the frequency of the compensation rope (16).

It can be shown that the motion u of the active tendon results in parametric excitation which facilitates active control. Treating the compensating rope as a string and taking into account the effect of stretching a simplified single-mode model can be represented by the following equation:

$$m\ddot{y} + \frac{\pi^2}{L}[T + \alpha y^2 + \beta u(t)]y = 0 \tag{3}$$

where y represents the dynamic displacement, $\alpha$ and $\beta$ are known coefficients, and the mean tension is represented by the equation:

$$T = Mg + mg\frac{L}{2} \tag{4}$$

The servo actuators (34), (36) may be any suitable servo actuator such as, for example, those described herein. The servo actuators may be associated with a controller (38) configured to adjust the position of the first and second moveable carriages (30), (32) in response to the position and sway of the building. The controller may be configured with a feedback loop that has a predetermined threshold for when the building sway too closely approximates the position and sway of the compensation ropes (16). When such a threshold is crossed, the controller (38) may be configured to adjust the position of the first and second moveable carriages (30), (32). Stabilization can be achieved through negative lateral velocity feedback as indicated in the following equation:

$$u(t) = -Kw_t(L,t) \tag{5}$$

where u(t)=control input force, K=a positive gain constant, and $w_t(L,t)$=the lateral velocity of the ropes at end x=L.

In one version, the moveable carriage (30) will position the fixed end of the compensation rope (16) where it would be positioned if the building were not swaying. For example, if the twice integrated accelerometer output indicates that the top of the building has moved to a position of +100 mm in the X-axis and +200 mm in the Y-axis, the termination of the compensation rope (16) will be moved to a position of −100 mm in the X direction and −200 mm in the Y direction. The servo actuators 34, 36 may be associated with follow up devices including, for example, position encoders. Digital systems may include rotary encoders or linear encoders that are optical or magnetic.

The versions presented in this disclosure are described by way of example only. Those skilled in the art can develop modifications and variants that do not depart from the spirit and scope of the disclosed cavitation devices and methods. Thus, the scope of the invention should be determined by appended claims and their legal equivalents, rather than by the examples given.

We claim:

1. An elevator system comprising:

(a) an elevator car;

(b) a counter weight;

(c) a compensation rope, the compensation rope being affixed at a first end to the elevator car and at a second end to the counterweight;

(d) a moveable compensation sheave, the compensation rope being wrapped around the compensation sheave;

(e) a servo actuator, wherein the servo actuator adjusts the position of the moveable compensation sheave; and (f) a controller, wherein the controller compares the natural frequency of the building structure and the natural frequency of the compensation rope and directs the servo actuator to adjust the position of the moveable compensation sheave if the compared frequencies are substantially similar.

2. The elevator system of claim 1, wherein the servo actuator adjusts the position of the moveable compensation sheave such that the natural frequency of the compensation rope is different from the natural frequency of the building structure.

3. The elevator system of claim 1, wherein the servo actuator adjusts the position of the moveable compensation sheave in a vertical direction.

4. The elevator system of claim 1, wherein the servo actuator adjusts the position of the moveable compensation sheave within a defined range.

5. The elevator system of claim 1, wherein the controller directs the servo actuator to adjust the position of the moveable compensation sheave based upon a feedback algorithm programmed into the controller.

6. An elevator system comprising:

(a) an elevator car;

(b) a first moveable carriage connected with a bottom surface of the elevator car;

(c) a first servo actuator, wherein the first servo actuator adjusts the position of the first moveable carriage;

(d) a counter weight;

(e) a compensation rope, the compensation rope being affixed at a first end to the first moveable carriage and at a second end to the counterweight;

(f) a compensation sheave, the compensation rope being wrapped around the compensation sheave; and (g) a controller, wherein the controller directs the first servo actuator to adjust the position of the first moveable carriage to correspondingly adjust the position of the compensation rope.

7. The elevator system of claim 6, wherein the first moveable carriage translates in front-to-back and side-to-side directions along the bottom surface of the elevator car.

8. The elevator system of claim 6, wherein the controller is preprogrammed with a control algorithm to adjust the position of the compensation rope such that it substantially matches the position of a building structure.

9. The elevator system of claim 6, further comprising a second moveable carriage connected with a bottom surface of the counterweight, wherein the second end of the compensation rope connects to the second moveable carriage.

10. The elevator system of claim 9, wherein the first moveable carriage and the second moveable carriage to adjust the position of the compensation rope to match the position of a building structure.

* * * * *